United States Patent [19]

Persyn

[11] Patent Number: 5,031,320

[45] Date of Patent: Jul. 16, 1991

[54] VACUUM HAIR CUTTER

[76] Inventor: David C. Persyn, 9108 Seymour Rd., Swartz Creek, Mich. 48473

[21] Appl. No.: 422,175

[22] Filed: Oct. 16, 1989

[51] Int. Cl.[5] ..... B25F 3/00

[52] U.S. Cl. ..... 30/133; 30/206

[58] Field of Search ..... 30/133, 41, 41.5, 206, 30/240, 263, 264

[56] References Cited

U.S. PATENT DOCUMENTS

| | | | |
|---|---|---|---|
| 3,808,924 | 5/1974 | Ferguson | 30/133 X |
| 4,219,931 | 9/1980 | Vacilotto | 30/133 |
| 4,314,405 | 2/1982 | Park | 30/133 |
| 4,590,675 | 5/1986 | Louw | 30/133 |
| 4,670,982 | 6/1987 | Kim | 30/133 |

*Primary Examiner*—Douglas D. Watts
*Assistant Examiner*—Willmon Fridie, Jr.
*Attorney, Agent, or Firm*—Donald C. Bolger

[57] ABSTRACT

A hand held vacuum hair cutting device containing a turning plate, a stationary plate, and a positioning plate which can be adjusted to cut hair to a desired length. An electric motor turns a flexible rotating nylon trim line which is located between the stationary plate and the positioning plate. A fan creates a vacuum which pulls the hair through the turning plate, the stationary plate, and the positioning plate where the hair is cut to the desired length by the rotating nylon trim line. A filter is located between the fan and the nylon trim line which collects the hair. The length of hair to be cut is determined by holes in the turning plate that are opened and closed by rotating the turning plate relative to the stationary plate and positioning plate. When rotating the turning plate so that the holes in the low position, hair is cut short. Likewise, when rotating the turning plate so that the holes are in the high position, hair is cut long. Various intermediate lengths of hair can be cut by simply turning the turning plate to an intermediate position.

9 Claims, 6 Drawing Sheets

VACUUM HAIR CUTTER

CROSS-REFERENCE TO RELATED APPLICATIONS: None

Statement as to right to inventions made under Federally sponsored research and development: Not Applicable.

BACKGROUND OF THE INVENTION

The field of the invention is generally that of hair cutters and more specifically hand held vacuum hair cutters.

The prior art consists mainly of connecting vacuum cleaner attachments to hair clippers to pick up cut hair. Although some of these clippers removed hair by vacuuming after the hair is cut, none of the clippers have a nylon trim line with a plate position feature which touches the surface being cut. Also none have a positioning plate feature which can be adjusted accurately to give a professional looking hair cut of any length.

A problem encountered frequently with the vacuum hair clippers is that the hair is not cut to the correct length and when trying to tapper the hair line the hair has to be cut over and over and most times the hair ends up too short by the trial and error method. The present invention solves these problems by providing a number of plates that can adjust the cutting nylon trim line from the surface being cut.

SUMMARY OF THE INVENTION

Generally speaking, the present invention comprises a novel means to cut hair that looks professionally pleasing in appearance.

A hand held vacuum hair cutting device containing a turning plate, a stationary plate, and a positioning plate which can be adjusted to cut hair to a desired length. The turning plate, stationary plate, and positioning plate have holes that can be aligned at various positions by rotating the turning plate. The length of hair to be cut is determined by holes in the turning plate that are opened and closed by rotating the turning plate relative to the stationary plate and positioning plate. When rotating the turning plate so that the holes are in the low position, hair is cut short. Likewise, when rotating the turning plate so that the holes are in the high position, hair is cut long. Various intermediate lengths of hair can be cut by simply turning the turning plate to an intermediate position.

An electric motor turns a shank that is attached to a blade or flexible rotating nylon trim line which is located between the stationary plate and the positioning plate. The electric motor also rotates a fan which creates a vacuum. This vacuum pulls the hair through the turning plate and the stationary plate where the hair is cut to the desired length by a rotating nylon trim line.

A filter, which is retained by a screen, is located between the fan and the blade or nylon trim line which collects the hair after the hair is cut. A vacuum plate is located between the fan and the screen which directs air flow through the center of the unit producing an accurate cut of the hair which enter the holes in the turning plate and stationary plate.

It is an object of the present invention to provide a novel hair cutter where skill is not required to cut hair.

It is another object of the invention to provide a novel hair cutter where the length of the hair cut can be easily adjusted.

It is a further object of the invention to provide a novel hair cutter where cut hair is gathered inside of the cutting unit.

It is another object of the invention to provide a flexible nylon trim line that does not need sharpening.

It is still another object of the invention to provide a flexible nylon trim line that can be replaced easily.

It is a further object of the invention to provide a safe cutter whereby fingers cannot be cut while adjusting the mechanism or cutting hair.

It is another object of the invention to provide a cutter that is efficient, economical, and durable that lowers the cost to cut hair.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

Figure 1:
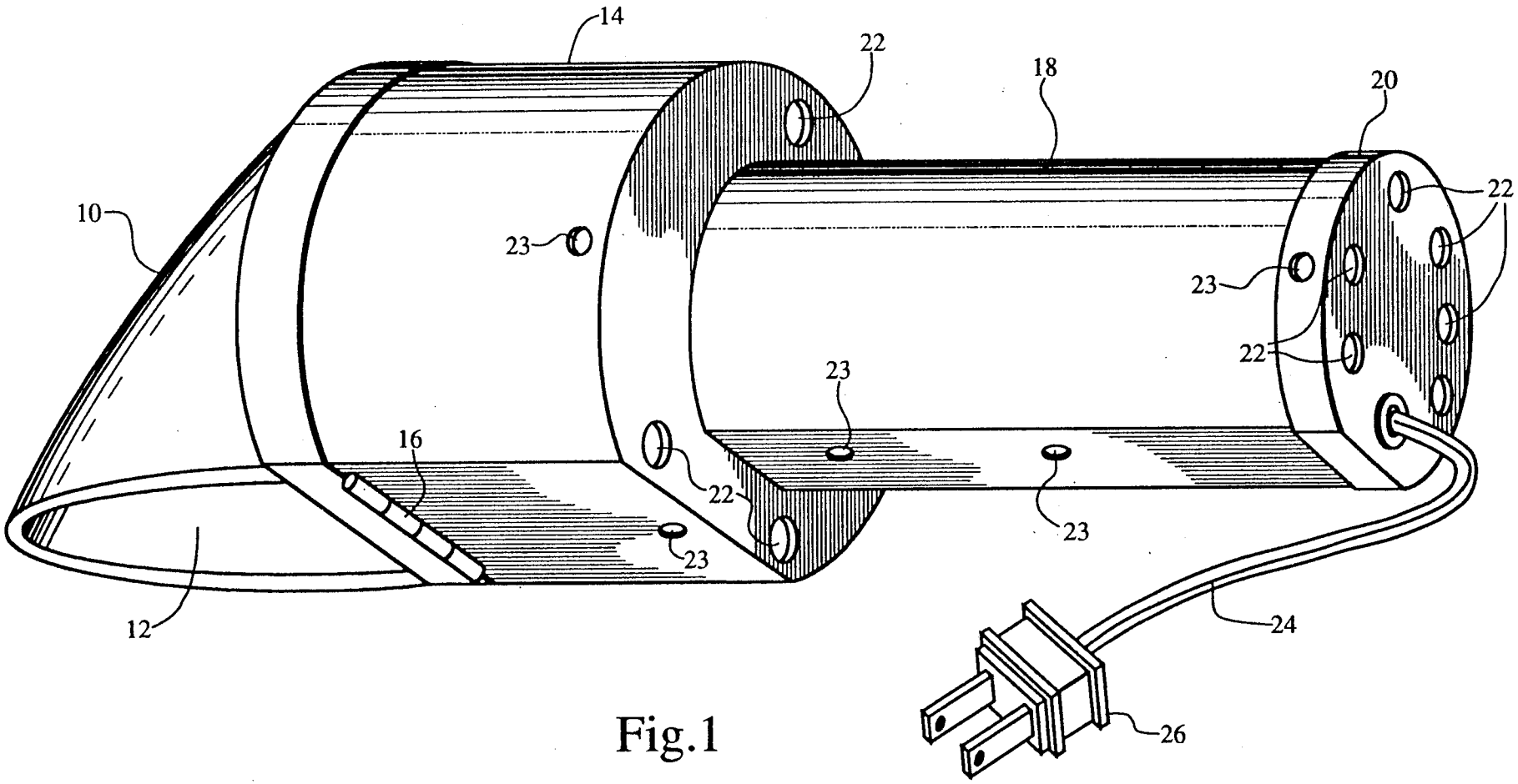
FIG. 1 is a three-dimensional perspective view showing one exemplary embodiment of one representative form of the invention as assembled.

Referring to FIG. 1, the hand held vacuum hair cutting device has vacuum cone 10 with air intake 12 that allows hair to be drawn into shell 14. Vacuum cone 10 is connected to shell 14 by hinge 16 and a press fit between vacuum cone 10 and shell 14. To open the unit, shell 10 is rotated at hinge 16 which exposes the inside of shell 14. Frame 18 is connected to shell 14 by welding, however, frame 18 and shell 14 can be made integral or attached with other fasteners. Cover 20 attaches to frame 18 by screws 23. Cover 20 and shell 14 have air exhaust holes 22 which allow air to flow through the unit. Electrical cord 24 also passes through cover 20. Electrical cord 24 has plug 26 at one end and attaches to motor 30 and switch 28 by a electrical connection in series. Electrical switch 28 is used to connect and disconnect electrical power to motor 30.

Figure 2:
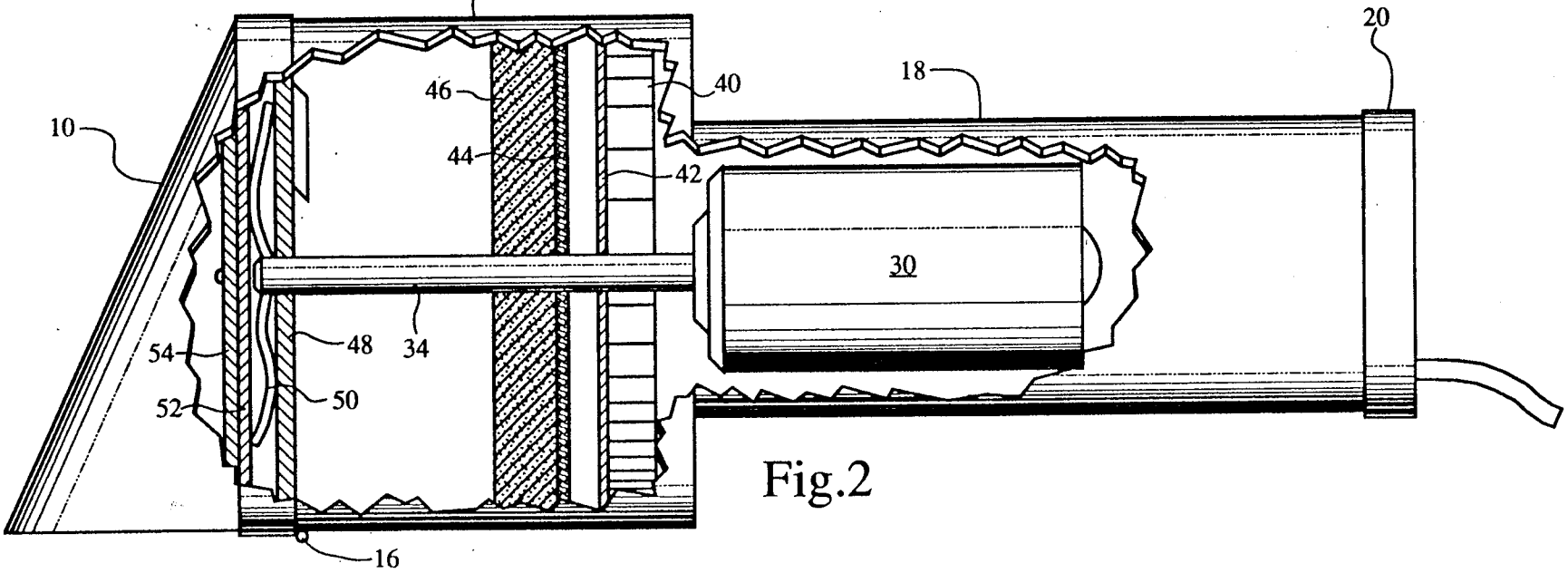
FIG. 2 is an elevation view showing one exemplary embodiment of one representative form of the invention with part of the exterior surface removed to show the relation of the internal parts.
Figure 3:
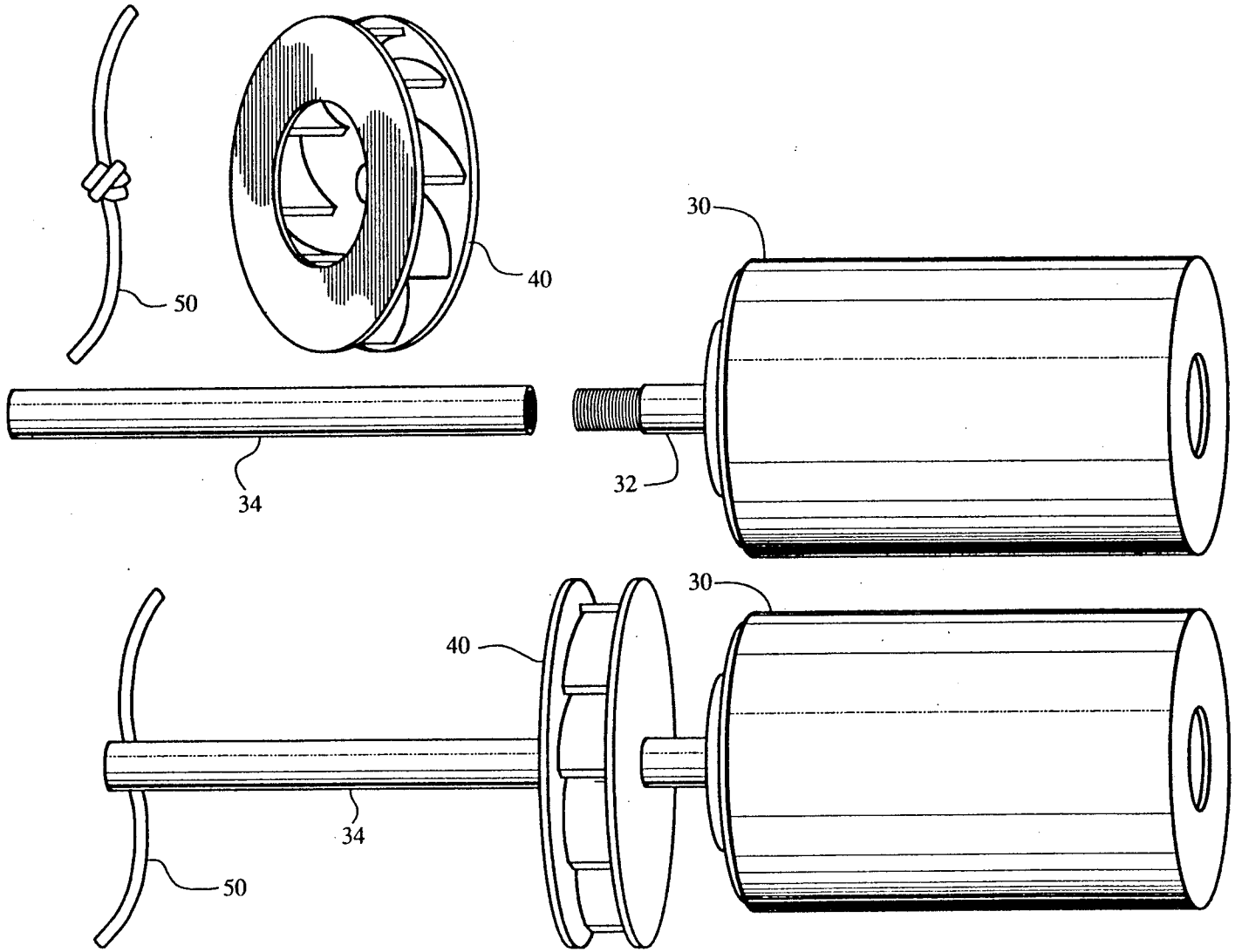
FIG. 3 is an elevation view showing one exemplary embodiment of one representative form showing how the motor is connected to the shank.

Referring to FIG. 2, the position of the parts in the assembly are shown. In FIG. 3, electrical motor 30 has shaft 32 which is connected to hollow shank 34. Shank 34 is threaded inside one end and has holes 36 in opposite end. The threads on shank 34 are such (left hand) that when motor 30 rotates (counter clockwise) shank 34 tends to tighten onto shaft 32. Fan 40 is attached to shaft 32 by shank 34.

Figure 4:
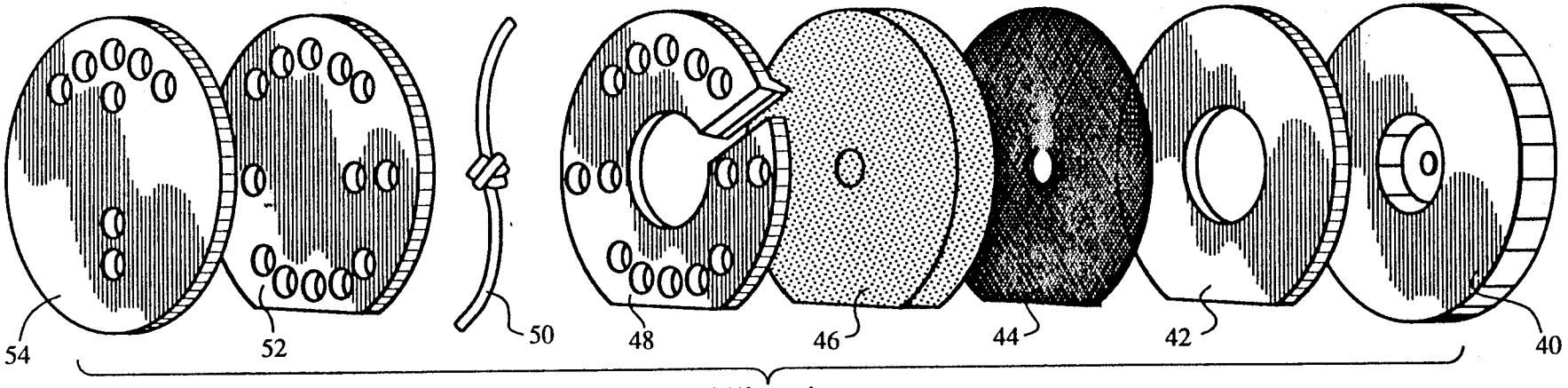
FIG. 4 is a three-dimensional perspective view showing one exemplary embodiment of one representative form of the invention in a exploded view.

Referring to FIG. 4, vacuum plate 42 has a one inch hole in the center which is used to direct the flow of the air moving inside of shell 14. Vacuum plate 42 is placed over shank 34 with a small clearance to fan 40. Screen 44 is also placed over shank 34 about one-fourth inch from vacuum plate 42. Filter 46 is likewise placed over shank 34 until it contacts screen 44. Screen 44 and vacuum plate 42 arc held in place by welding to shell 14, however, other means such as a press fit could also be used. This allows shank 34 to rotate while vacuum plate 42, screen 44, and filter 46 to remain stationary with shell 14.

Figure 5:
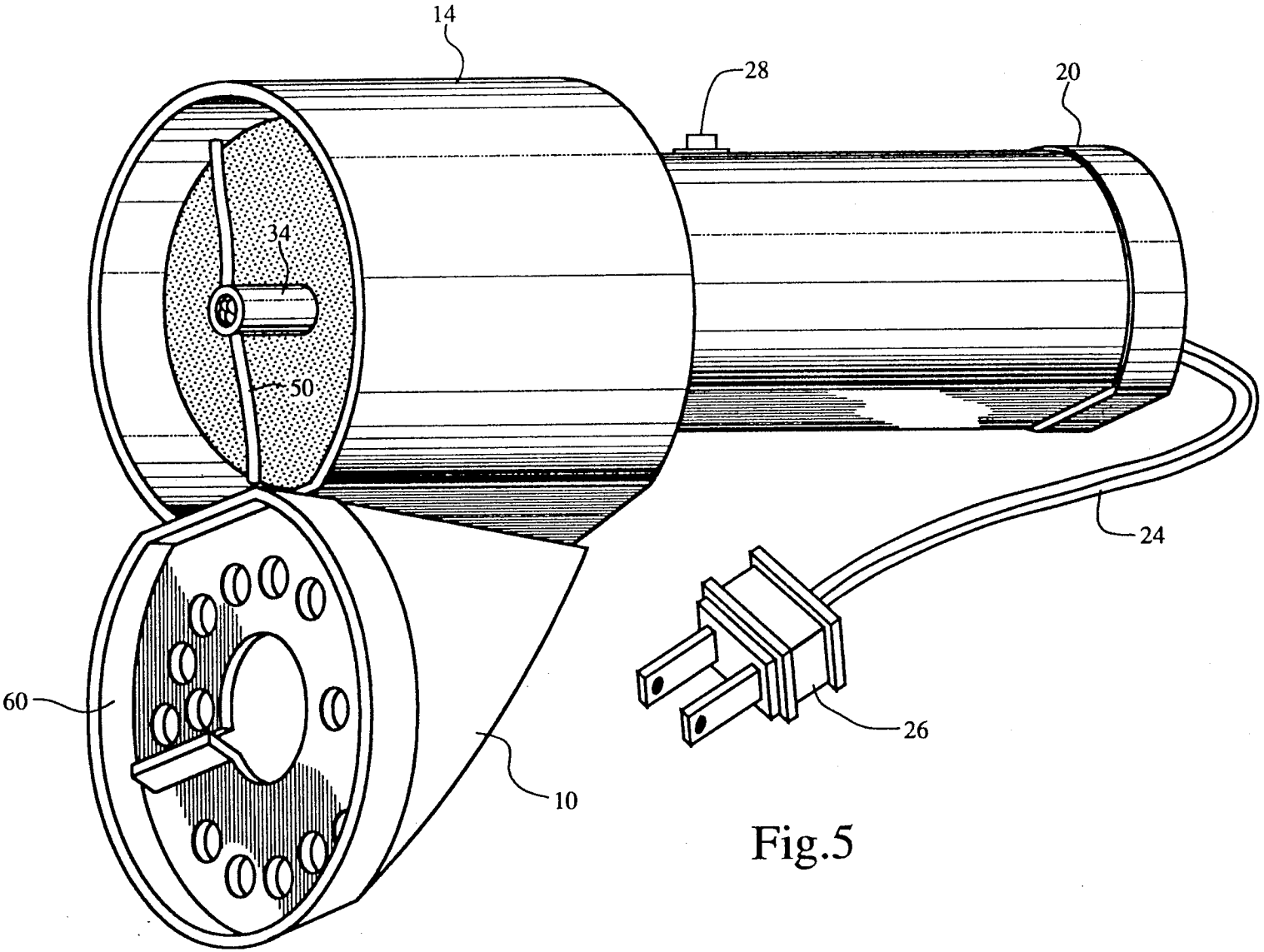
FIG. 5 is a three-dimensional perspective view showing one exemplary embodiment of one representative form of the invention with the vacuum cone in the open position.
Figure 14:
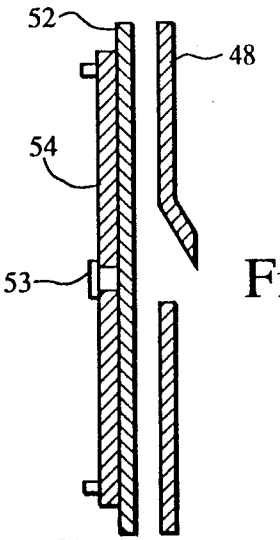
FIG. 14 is an cross section view showing one exemplary embodiment of one representative form of the space between the stationary plate and the positioning plate.

Referring to FIG. 5, vacuum cone 10 has circular recessed portion 60. With vacuum cone 10 in the open position as shown in FIG. 5, turning plate 54 is connected to stationary plate 52 by shoulder screw 53 which allows turning plate 54 to rotate relative to stationary plate 52 as shown by FIG. 14. Turning plate 54 and stationary plate 52 are inserted into recessed portion 60 of vacuum cone 10 with turning plate 54 entering the recessed portion 60 first. Next, positioning plate 48 is inserted into recessed portion 60 so that positioning plate 48 is flush with the exterior end of recessed portion 60. Both stationary plate 52 and positioning plate 48 are held in place by a press fit with recessed portion 60 of vacuum cone 10, or by other means, such as welding.

Figure 6:
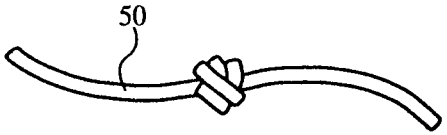
FIG. 6 is an elevation view showing one exemplary embodiment of one representative form of the nylon trim line blade.
Figure 8:
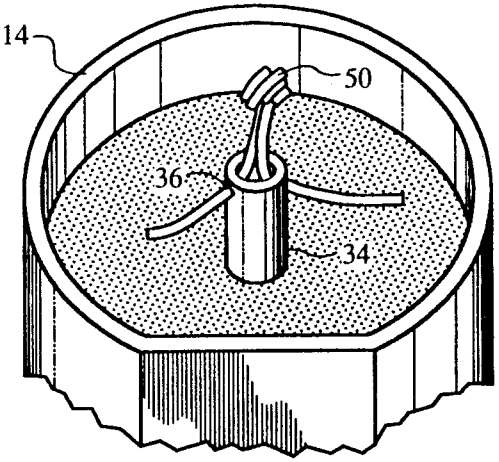
FIG. 8 is a three-dimensional perspective view showing one exemplary embodiment of one representative form of how the nylon trim line is attached to the shank that is connected to the motor.
Figure 10:
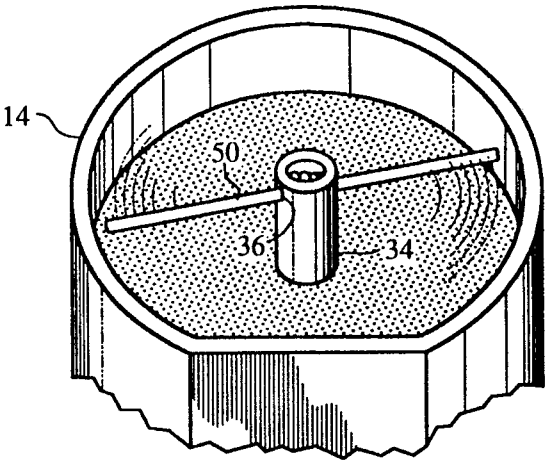
FIG. 10 is a three-dimensional perspective view showing one exemplary embodiment of one representative form of the nylon trim line in the rotating position.
Figure 7:
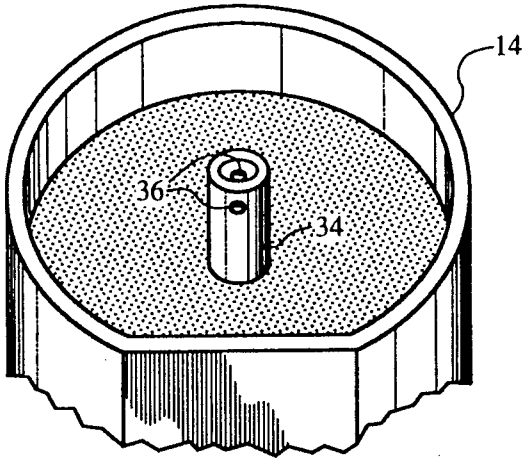
FIG. 7 is a three-dimensional perspective view showing one exemplary embodiment of one representative form of the hole in the shank that is connected to the motor.
Figure 9:
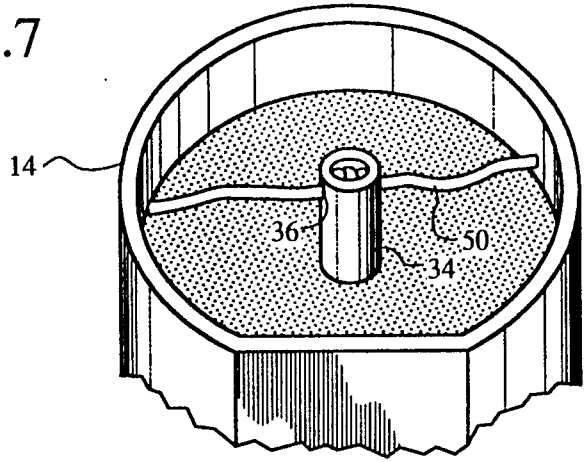
FIG. 9 is a three-dimensional perspective view showing one exemplary embodiment of one representative form of the nylon trim line in the ready position.

Referring to FIG. 6, nylon trim line 50 consists of a nylon trim line with a knot tied in the middle for retention to shank 34. Various other types of blades could also be used. Multiple nylon trim lines could also be used to refine the cutting system. FIG. 7 shows shank 34 with holes 36 ready to receive nylon trim line 50. Referring to FIG. 8, nylon trim line 50 is attached to shank 34 by inserting both ends of nylon trim line 50 into the hollow center of shank 34 and then through holes 36. Nylon trim line 50 is pulled through hole 36 until nylon trim line 50 assumes a position as in FIG. 9. When motor 30 rotates, nylon trim line 50 straights out due to centrifugal force as shown in FIG. 10.

Figure 11:
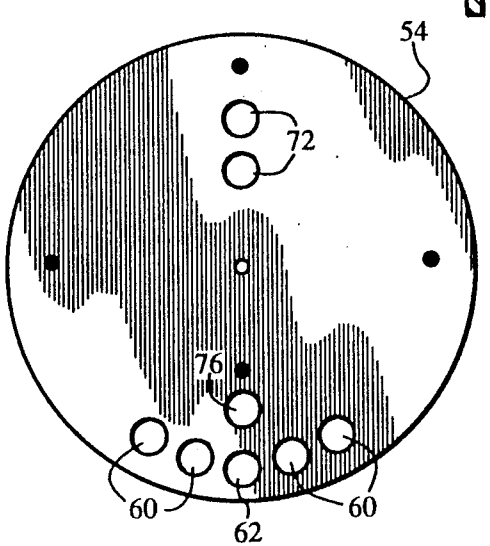
FIG. 11 is an elevation view showing one exemplary embodiment of one representative form of the turning plate.
Figure 12:
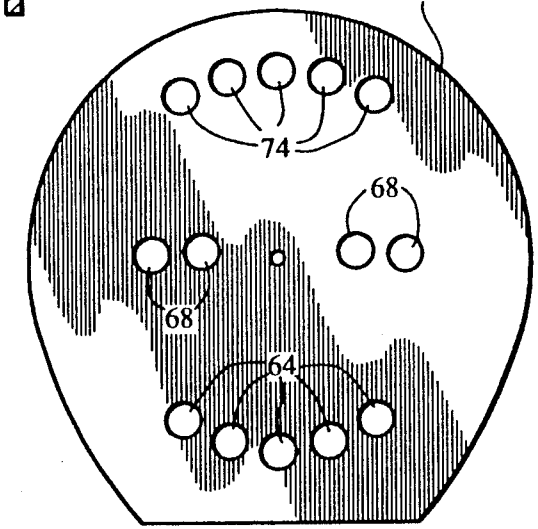
FIG. 12 is an elevation view showing one exemplary embodiment of one representative form of the stationary plate.
Figure 13:
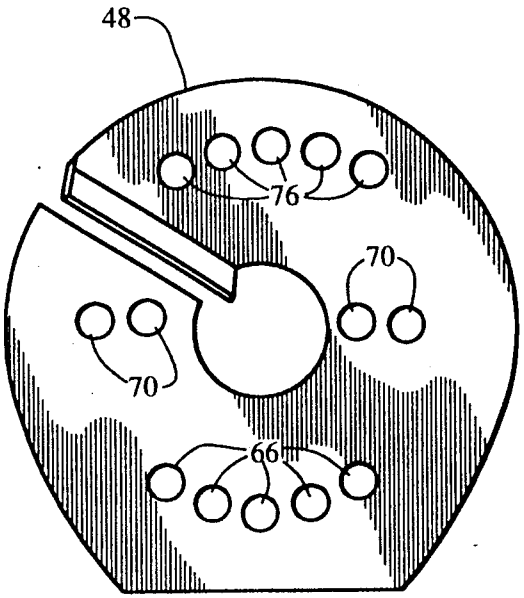
FIG. 13 is an elevation view showing one exemplary embodiment of one representative form of the positioning plate.

Referring to FIG. 11, 12, and 13 at least one opening is required for the system to function however, many different combination of opening can be used. As shown by FIG. 11, turning plate 54 has four holes 60, two holes 72, one hole 76, and one hole 62 for a total of eight holes. As shown by FIG. 12, stationary plate 52 has five holes 64, four holes 68, and five holes 74 for a total of fourteen holes. As shown by FIG. 13, positioning plate 48 has five holes 66, four holes 70, and five holes 76 for a total of fourteen holes. Five holes 60 in turning plate 54 align with five holes 64 in stationary plate 52 and also align with five holes 66 in positioning plate 48 when turning plate 54 is adjusted in the lower position as shown in FIG. 11. In the intermediate position, turning plate 54 is rotated 90 degrees from the position in FIG. 11 either clockwise or counter clockwise so that hole 62 and hole 76 in turning plate 54 align with holes 68 in stationary plate 52 and also align with holes 70 in positioning plate 48. In the long cutting position, turning plate 54 is rotated 180 degrees from the position in FIG. 11 either clockwise or counter clockwise so that holes 60 and hole 62 in turning plate 54 align with holes 74 in stationary plate 52 and also align with holes 76 in positioning plate 48. The cutting action of nylon trim line 50 cuts best when holes 64, 66, 68, 70, 74, and 76 have a very small or no chamfer.

Referring to FIG. 2, turning plate 54 can be adjusted to cut hair to any desired length with different holes in turning plate 54, stationary plate 52, and positioning plate 48 and aligned accordingly. Turning plate 54, stationary plate 52, and positioning plate 48 have holes that can be aligned at various positions by rotating turning plate 54. The length of the hair cut is determined by holes in turning plate 54 that are opened and closed by rotating turning plate 54 relative to stationary plate 52 and positioning plate 48. Rotating turning plate 54 so that the holes in the low position as shown in FIG. 11, 12, 13, hair is cut short. Likewise, rotating turning plate 54 so that the holes are in the opposite position, hair is cut long. Various intermediate lengths of hair can be cut by rotating turning plate 54 to an intermediate position and adding more holes at various positions for cutting.

Electric motor 30 turns fan 40, shank 34, and nylon trim line 50 which is located between stationary plate 52 and positioning plate 48. Electric motor 30 also rotates fan 40 which creates a vacuum in shell 14 and causes air to flow through air intake 12 and out air exhaust ports 22 in cover 20 and shell 14. This air flow pulls hair through air intake 12 and through turning plate 54, stationary plate 52, and positioning plate 48 where the hair is cut to the desired length by the rotating nylon trim line 50. Cut hair then moves to contact filter 46 where the hair is retained for later removal.

Filter 46 is retained by shell 14 and screen 44 and collects the hair after the hair is cut. To removed cut hair from the unit, vacuum cone 10 is lowered as in FIG. 5 and the hair is removed.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to include substantially equivalent constructions embodying the basic teachings and inventive concept of the present invention.

What is claimed is:

1. A suction type hair cutting device comprising:

a frame defining a passage having an inlet and an outlet;

an electric motor mounted on said frame;

at least one trim line operatively connected to said motor so as to be operated by said motor;

means interconnecting said motor and said trim line for moving said trim line when said motor is operating;

a fan operatively connected to said motor so as to be operated by said motor causing air to flow from said inlet to said outlet;

a plate having at least one opening mounted on said frame adjacent to said trim line whereby said trim line will cut off hair that protrudes through said plate opening.

2. A device as in claim 1, wherein said trim line is made from plastic.

3. A device as in claim 1, wherein said trim line is made from nylon.

4. A suction type hair cutting device comprising:

a frame defining a passage having an inlet and an outlet;

an electric motor mounted on said frame;

at least one trim line operatively connected to said motor so as to be operated by said motor;

means interconnecting said motor and said trim line for moving said trim line when said motor is operating;

a fan operatively connected to said motor so as to be operated by said motor causing air to flow from said inlet to said outlet;

a first plate having at least one opening mounted on said frame adjacent to said trim line whereby said trim line will cut off hair that protrudes through said plate opening.

a second plate having at least one opening mounted on said frame parallel to said first plate whereby said first plate can be rotated relative to said second plate to produce a different opening alignment whereby hair entering said openings where are aligned is cut off by said trim line at different lengths.

5. A device as recited in claim 4, wherein said trim line is plastic.

6. A device as recited in claim 4, wherein said trim line is nylon.

7. A suction type hair cutting device comprising:

a frame defining a passage having an inlet and an outlet;

an electric motor mounted on said frame;

at least one trim line operatively connected to said motor so as to be operated by said motor;

means interconnecting said motor and said trim line for moving said trim line when said motor is operating;

a fan operatively connected to said motor so as to be operated by said motor causing air to flow from said inlet to said outlet;

a first plate having at least one opening mounted on said frame adjacent to said trim line whereby said trim line will cut off hair that protrudes through said plate opening.

a second plate having at least one opening mounted on said frame parallel to said first plate whereby said first plate can be rotated relative to said second plate to produce a different opening alignment whereby hair entering said openings where are aligned is cut off by said trim line at different lengths.

a third plate having at least one opening mounted on said frame parallel to aid first and second plate whereby a space is provided for a trim line between said second plate and said third plate whereby said second plate opening provides a shearing surface for said trim line.

8. A device as recited in claim 7, wherein said trim line is plastic.

9. A device as recited in claim 7, wherein said trim line is nylon.

* * * * *